US007897014B2

(12) United States Patent
Lundberg et al.

(10) Patent No.: US 7,897,014 B2
(45) Date of Patent: Mar. 1, 2011

(54) ARRANGEMENT FOR THE TREATMENT OF CELLULOSE PULP IN A WASHING APPARATUS ARRANGED WITH DISPLACED PERIPHERAL VALVE SEALS

(75) Inventors: Jörgen T. Lundberg, Sundsvall (SE); Rickard Andersson, Matfors (SE); Johan Bylander, Sundsvall (SE); Magnus Henriksson, Sundsvall (SE)

(73) Assignee: Metso Paper, Inc. (FI)

( * ) Notice: Subject to any disclaimer, the term of this patent is extended or adjusted under 35 U.S.C. 154(b) by 372 days.

(21) Appl. No.: 11/921,373

(22) PCT Filed: May 22, 2006

(86) PCT No.: PCT/SE2006/050146

§ 371 (c)(1), (2), (4) Date: Aug. 25, 2008

(87) PCT Pub. No.: WO2006/130096

PCT Pub. Date: Dec. 7, 2006

(65) Prior Publication Data

US 2008/0314541 A1 Dec. 25, 2008

(30) Foreign Application Priority Data

Jun. 3, 2005 (SE) ..... 0501287

(51) Int. Cl.
*D21G 3/00* (2006.01)

(52) U.S. Cl. ..... 162/272

(58) Field of Classification Search ..... 162/272, 162/232; 134/115 R
See application file for complete search history.

(56) References Cited

U.S. PATENT DOCUMENTS 6,086,713 A * 7/2000 Qvintus et al. ..... 162/60
6,159,338 A * 12/2000 Qvintus et al. ..... 162/56
6,461,473 B1 * 10/2002 Qvintus et al. ..... 162/43

FOREIGN PATENT DOCUMENTS

EP 0 239 312 A1 9/1987
WO WO-97/10380 A1 3/1997
WO WO-98/33972 A1 8/1998

* cited by examiner

*Primary Examiner*—Mark Halpern
(74) *Attorney, Agent, or Firm*—Lerner, David, Littenberg, Krumholz & Mentlik, LLP

(57) ABSTRACT

A washer for washing and dewatering cellulosic pulp is disclosed, comprising a rotary drum with a plurality of external compartments defined by axial compartment walls distributed along the drum's circumference, a stationary cylindrical casing enclosing the drum, whereby a ring-shaped space is defined between the casing and the drum and where longitudinal seals divide the ring-shaped space into a forming zone for forming the pulp, at least one washing zone for washing the pulp at overpressure, and a discharge zone for feeding out the washed pulp, and the filtrates from different washing stages are collected in a peripheral valve located at the drum's end wall, the filtrate stages are separated by seals in the valve, and at least some of the valve seals are displaced in relation to the corresponding longitudinal seal, as seen in the direction of rotation of the drum.

3 Claims, 2 Drawing Sheets

ARRANGEMENT FOR THE TREATMENT OF CELLULOSE PULP IN A WASHING APPARATUS ARRANGED WITH DISPLACED PERIPHERAL VALVE SEALS

This application is a 371 of PCT/SE2006/050146 filed 22 May 2006.

FIELD OF THE INVENTION

The present invention relates to a washer of the type comprising a compartmented drum for washing and dewatering cellulose pulp.

BACKGROUND OF THE INVENTION

All fiber lines include some type of washer in order to separate digestion liquor from the pulp. Later on in the process a washing arrangement is provided to separate bleaching liquors after bleaching stages. There exist several different types of washing arrangements operating according to different principles.

One type of washing arrangement is the drum washer where the pulp is dewatered on a rotary filter drum after the addition of washing liquid, which displaces the liquor remaining on the pulp web after preceding processing stages, for example a digestion or bleaching stage. The static pressure causes the displaced liquor to pass through perforated metal sheet mounted on the rotary drum. A further development of the original drum washer is the pressurized displacement washer where the filtrate at overpressure, is caused to pass through the metal sheet. The increased pressure difference effects an improved dewatering of the pulp. In the pressurized displacement washer the increased pressure difference can cause the pulp web to deposit itself harder on the metal sheet of the drum and at times must be removed by some kind of auxiliary means. The pulp web, for example, then can be loosened by means of liquid or air.

According to a known design of a pressurized displacement washer, the drum is provided with compartments, in which the pulp places itself in the form of rectangles, oval in the axial direction of the drum against the metal sheet. The compartmentalization of the drum ensures that the pulp cake does not break up and starts moving, but instead maintains the form brought about at the deposition of the pulp. The compartments consist of bars placed axially along the entire axle of the drum, which bars are the walls of the compartments. The perforated metal sheet, on which the pulp deposits, is located spaced from the drum, so that filtrate channels are formed in the space between the drum and the sheet. Along the circumference of the drum there are, thus, at least as many filtrate compartments as pulp compartments. In a drum washer a plurality of different washing stages can be carried out, with separate addition of washing liquid to the different stages, and also recycling of filtrate from one stage as washing liquid to another stage.

In order to maintain maximum washing effectiveness, it is desirable to ensure that washing liquid intended for a specific washing stage is not moved to a later washing stage. Washing liquid intended for a washing stage later in the process is cleaner than washing liquid used in a preceding washing stage. A difference in pressure between the stages causes added washing liquid to tend to move to the lower pressure. In order to be able to separate different washing stages as well as forming stages and discharging stages, the respective zones are sealed by axial seals, which are placed between the compartment walls of the rotary drum and the surrounding pressure-bearing casing.

In order to increase the effectiveness of a washing apparatus, it can be designed so that the washing liquid is caused to move in a countercurrent flow through the pulp. It is thereby intended that filtrate from a washing stage is recycled as washing liquid to a preceding washing stage. In cases when the washing arrangement is of the type compartmented drum, often a peripheral valve is mounted on one or both of the end walls of the drum, in order to collect filtrate from the filtrate channels. The filtrate, thus, is moved in axial direction of the drum outward to one or both of the drum end walls. In order to separate the filtrate from the different washing stages, the valve is provided with seals, which define different parts in the valve. The filtrate is then pumped on to a preceding washing stage alternatively to a filtrate tank. The seals of the valve are placed so that they are in line with the seals defining each washing stage. In this way all filtrate from a washing stage will be collected within the same area in the peripheral valve.

It has been found, however, that the division of filtrate does not work satisfactorily. In a washing zone there is space for several compartments. The filtrate in the channels of the compartments located at the end of the washing zone lands on the wrong side of the seal placed in the valve. In this way part of the filtrate from a washing stage will be mixed with filtrate from subsequent washing stages. As the filtrate from the next following washing stage is cleaner, this filtrate is slightly contaminated. When then the filtrate from the subsequent washing stage is then re-used as washing liquid in a preceding washing stage, the washing effectiveness is deteriorated. In order to reduce this effect, the channels have been made more shallow, so that the volume is decreased and consequently not as much of the filtrate can be transferred. The shallow channels, however, give rise to high pressure drops in the channels, which causes capacity and effectiveness problems.

One object of the present invention is to eliminate or at least reduce the aforesaid problems.

SUMMARY OF THE INVENTION

In accordance with the present invention, these and other objects have now been realized by the invention of a washer for washing and dewatering cellulosic pulp material comprising a rotary drum having an end wall, a plurality of axial compartment walls disposed on the rotary drum defining a plurality of axial compartments therebetween, a stationary cylindrical casing enclosing the rotary drum thereby defining a ring-shaped space between the stationary cylindrical casing and the rotary drum, a plurality of axial seals dividing the ring-shaped space into a forming zone for forming the cellulosic pulp material, at least one washing zone for washing the cellulosic pulp material under an overpressure, and a discharge zone for discharging the washed cellulosic pulp material, a peripheral valve disposed at the end wall for collecting filtrate from the cellulosic pulp material, and a plurality of valve seals for separating the filtrate from each of the zones, at least one of the plurality of valve seals being displaced with respect to the corresponding plurality of axial seals along the direction of rotation of the rotary drum. In a preferred embodiment, the at least one washing zone comprises a plurality of washing zones, and each of the plurality of valve seals associated with each of the plurality of washing zones is displaced with respect to the corresponding plurality of axial seals along the direction of rotation of the rotary drum.

In accordance with one embodiment of the washer of the present invention, the at least one washing zone comprises a first washing zone and a second washing zone, and the plurality of valve seals disposed between the first and second washing zones and between the washing zone and the discharge zone are displaced with respect to the corresponding plurality of axial seals along the direction of rotation of the rotary drum.

By moving the seal in the peripheral valve in the direction of rotation of the drum, the filtrate in the channels located at the end of a washing zone is also collected in the right part of the valve. In this manner a correct handling of the filtrate is ensured, and the volume of the channels and thereby their height can be increased, which implies that the problem of pressure drop is decreased and the capacity is increased.

The washing arrangement thus comprises a rotary drum with a plurality of external compartments on the drum for the pulp to be washed, which compartments are defined by axial compartment walls distributed along the circumference of the drum, a stationary cylindrical casing enclosing the drum, whereby a ring-shaped space is defined between the casing and the drum, and where the ring-shaped space by means of longitudinal seals in the axial direction of the drum is divided into a forming zone for forming the pulp in the compartments of the drum, at least one washing zone for washing the pulp at overpressure, and a discharge zone for feeding out the washed pulp.

The compartments on the drum are divided into pulp compartments and filtrate compartments separated by a perforated metal sheet, on which the pulp deposits.

The filtrates are caused to pass through the metal sheet and land in the filtrate compartments below the sheet. Every filtrate compartment can preferably be divided into a number of filtrate channels. In these filtrate channels the filtrate flow in the axial direction of the drum to one or both of the end walls of the drum, where a peripheral valve for collecting the filtrate is located.

The peripheral valve is divided by valve seals, so that there is at least one part in the valve which corresponds to each treatment zone in the washing arrangement. According to the present invention, at least some of the valve seals in the valve are displaced in the direction of rotation of the drum in relation to the corresponding longitudinal seal defining the different treatment zones. The valve seals located at the end of a washing zone are preferably displaced in relation to the corresponding longitudinal seal.

BRIEF DESCRIPTION OF THE DRAWINGS

The present invention is described in greater detail in the following detailed description, with reference to the Figures, in which.

DETAILED DESCRIPTION

Figure 1:
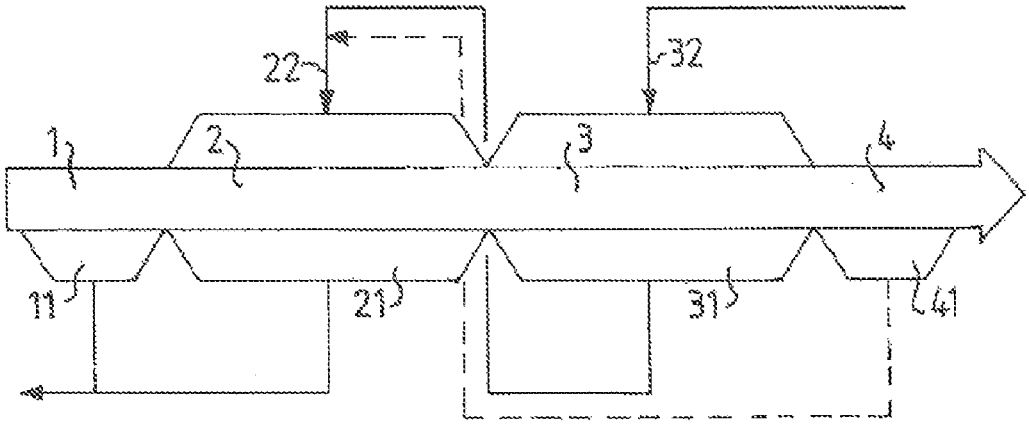
FIG.1 (PRIOR ART)
FIG. 1 is a schematic representation of a washing arrangement with two washing zones and countercurrent recycling of filtrate according to the prior art.

Referring to the Figures, in which like reference numerals refer to like elements thereof, FIG. 1 shows an outline diagram illustrating the filtrate flow according to the prior art with a countercurrent displacement washer with two washing stages. The pulp enters a forming zone 1 with associated filtrate collection 11. The pulp is moved to a first washing zone 2 with associated filtrate collection 21. In the first washing zone washing liquid is supplied in the washing liquid applicator 22. The pulp then arrives at a second washing zone 3, with associated filtrate collection 31 and washing liquid applicator 32. The washing arrangement terminates with a discharge zone 4, to which no washing liquid is added. The discharge zone has an associated filtrate collection 41. The first portion of the discharge zone acts as a pulp concentration increasing zone. Washing liquid to the second washing zone 3 is supplied by means of the washing liquid applicator 32. The filtrate from the filtrate collection 31 of the second washing zone is recycled to the washing liquid applicator 22 and is used as washing liquid for the first washing zone 2. The filtrate from the pulp concentration increasing zone can possibly be recycled as washing liquid to the first washing zone 2 according to the dashed line in the Figure.

The seal in the peripheral valve is placed in line with the seal for the corresponding washing stage, i.e. the axial longitudinal seal. The extension of the filtrate collection corresponds to the extension of the respective treatment zone.

Figure 2:
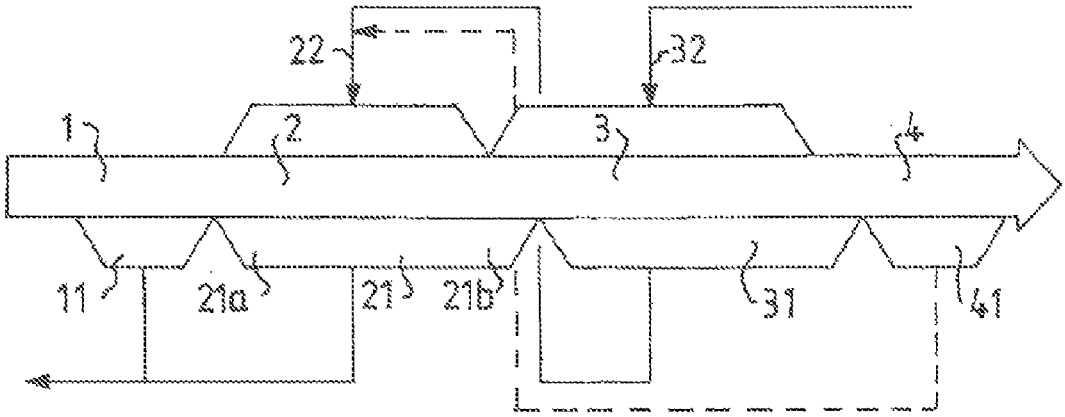
FIG. 2 is a schematic representation of a washing arrangement according to the present invention.

FIG. 2 shows a diagram of a washing arrangement according to the present invention. The pulp enters a forming zone 1 with associated filtrate collection 11. The pulp is moved to a first washing zone 2 with an associated filtrate collection 21. In the first washing zone washing liquid is added in the washing liquid applicator 22. The pulp then arrives at a second washing zone 3 with associated filtrate collection 31 and washing liquid applicator 32. The washing arrangement terminates with a discharge zone 4, to which no washing liquid is added. The discharge zone has an associated filtrate collection 41. Washing liquid to the second washing zone 3 is supplied by means of the washing liquid applicator 32. The filtrate from the filtrate collection 31 of the second washing zone is recycled to the washing liquid applicator 22 and is used as washing liquid for the first washing zone 2. The filtrate from the pulp concentration increasing zone in the discharge zone possibly can be recycled as washing liquid to the first washing zone 2 according to the dashed line in the Figure. The seal at the front portion 21*a* of the filtrate collection of the first washing zone is in line with the axial seal for the front portion of the first washing liquid applicator. The seal in the rear portion 21*b* of the filtrate collection is displaced in the direction of rotation of the drum in relation to the axial seal, which defines between the first and the second washing zone. The filtrate collection 21 thus has a greater extension than the corresponding treatment zone, the washing zone 2.

Figure 3:
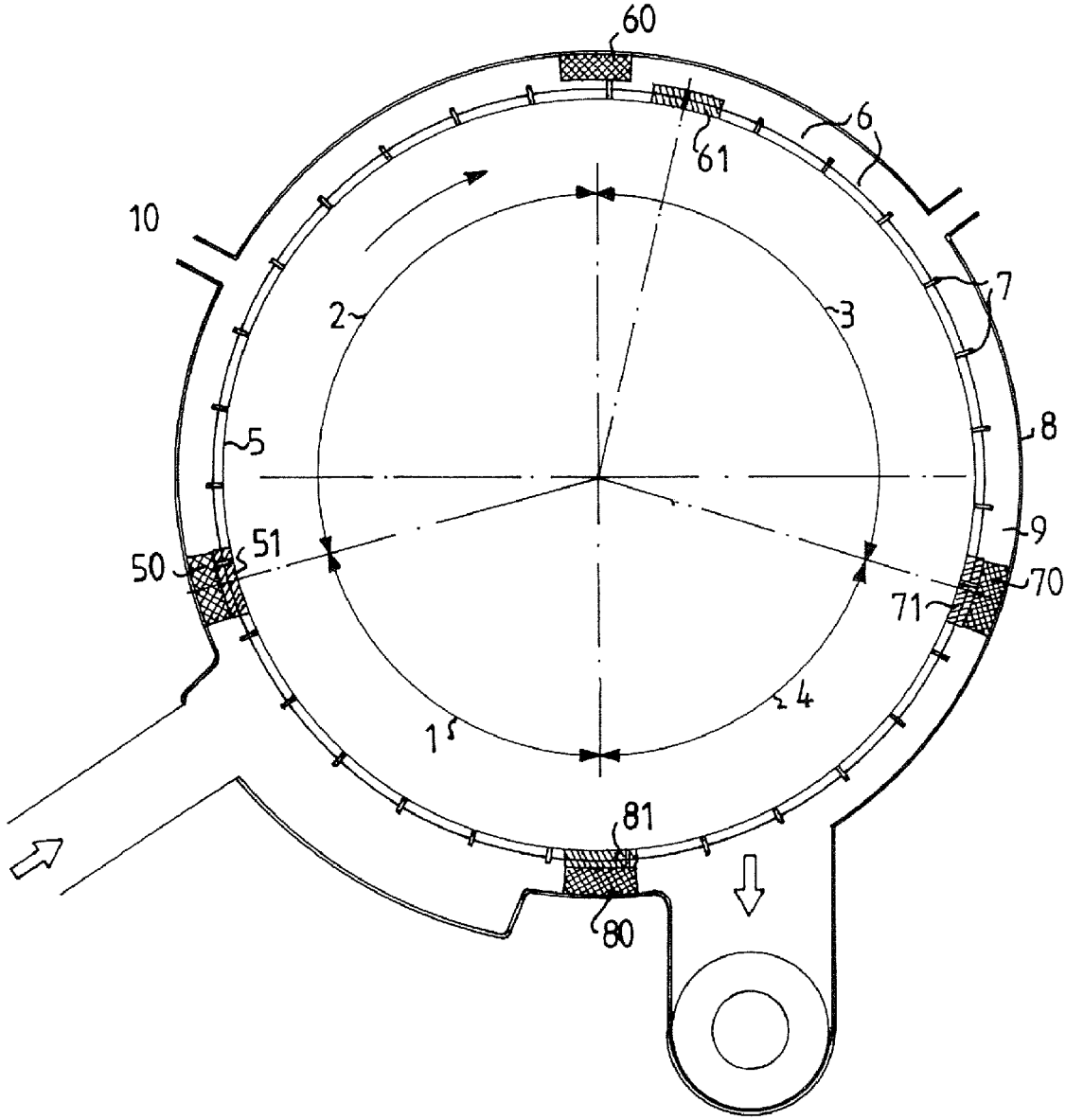
FIG. 3 is a side, elevational view from the end wall of a washing arrangement of the compartmented drum in accordance with the present invention.

FIG. 3 shows a washing arrangement according to the present invention, as seen from the end wall of the drum. The washing arrangement comprises a rotary drum 5 with a plurality of external compartments 6 on the drum for the pulp to be washed, which compartments are defined by axial compartment walls 7 distributed along the circumference of the drum, a stationary cylindrical casing 8 enclosing the drum, whereby a ring-shaped space 9 is defined between the casing and the drum and where the ring-shaped space by means of longitudinal seals, 50, 60, 70, and 80, in the axial direction of the drum is divided into a forming zone 1 for forming the pulp in the compartments of the drum, at least one washing zone, 2 and 3, for washing the pulp at overpressure and a discharge zone 4 for feeding out the washed pulp. In an end valve extending around the periphery of the drum are located a number of valve seals, 51, 61, 71, and 81, which define the different pulp collection zones. The pulp enters the forming zone 1 and is then moved on the rotary drum 5 to the first washing zone 2. Washing liquid is supplied by means of the inlet 10. The first washing zone is defined by a first axial seal 50 in the front portion of the first washing zone and a second axial seal 60 in the rear portion of the first washing zone. In line with the first axial seal 50 a valve seal 51 is located which is placed in the peripheral valve. The valve seal 51 has a limited extension in the axial direction and extends in the radial direction at the same level as the compartment walls 7, which are located axially on the drum. At the end of the first washing zone 2 a valve seal 61 is located, which is placed after the axial seal 60, as seen in the direction of rotation of the drum. The valve seal 61 is thus displaced in relation to the corresponding axial seal 60.

In FIG. 3 only the valve seal between the first and the second washing zones is displaced. The valve seals after each washing zone are preferably displaced in the direction of rotation of the drum, for example, thus, also the valve seal 71 is also displaced in the rotation direction of rotation of the drum in relation to the corresponding longitudinal seal 70.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A washer for washing and dewatering cellulosic pulp material comprising a rotary drum having an end wall, a plurality of axial compartment walls disposed on said rotary drum defining a plurality of axial compartments therebetween, a stationary cylindrical casing enclosing said rotary drum thereby defining a ring-shaped space between said stationary cylindrical casing and said rotary drum, a plurality of axial seals dividing said ring-shaped space into a forming zone for forming said cellulosic pulp material, at least one washing zone for washing said cellulosic pulp material under an overpressure, and a discharge zone for discharging said washed cellulosic pulp material, a peripheral valve disposed at said end wall for collecting filtrate from said cellulosic pulp material, and a plurality of valve seals for separating said filtrate from each of said zones, at least one of said plurality of valve seals being displaced with respect to the corresponding plurality of axial seals along the direction of rotation of said rotary drum.

2. The washer of claim 1 wherein said at least one washing zone comprises a plurality of washing zones, and wherein each of said plurality of valve seals associated with each of said plurality of washing zones is displaced with respect to the corresponding plurality of axial seals along the direction of rotation of said rotary drum.

3. The washer of claim 1 wherein said at least one washing zone comprises a first washing zone and a second washing zone, and wherein said plurality of valve seals disposed between said first and second washing zones and between said washing zone and said discharge zone are displaced with respect to the corresponding plurality of axial seals along the direction of rotation of said rotary drum.

* * * * *